US006473046B1

(12) United States Patent
Dickie et al.

(10) Patent No.: US 6,473,046 B1
(45) Date of Patent: Oct. 29, 2002

(54) DEVICE HAVING AN EXTENDABLE ANTENNA

(75) Inventors: James P. Dickie, Corvallis, OR (US); Dennis R Esterberg, Philomath, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/916,753

(22) Filed: Jul. 26, 2001

(51) Int. Cl.[7] ..... H01Q 1/24
(52) U.S. Cl. ..... 343/702; 455/89
(58) Field of Search ..... 343/702, 715, 343/900, 901; 455/89, 90

(56) References Cited

U.S. PATENT DOCUMENTS 5,684,672 A * 11/1997 Karidis et al. ..... 343/702
6,081,207 A 6/2000 Batio ..... 341/20
6,107,969 A * 8/2000 Gulino et al. ..... 343/702
6,181,284 B1 * 1/2001 Madsen et al. ..... 343/702
6,272,356 B1 * 8/2001 Dolman et al. ..... 455/550

* cited by examiner

*Primary Examiner*—Tan Ho
(74) *Attorney, Agent, or Firm*—Jeff D. Limon

(57) ABSTRACT

A device includes a first enclosure and a second enclosure. A first edge of the second enclosure is coupled to an edge of the first enclosure. The device also includes an antenna, located within the second enclosure, wherein the antenna is coupled to a linkage that cooperates with the first enclosure to extend the antenna when an edge opposite the first edge of the second enclosure is rotated about the edge of said first enclosure.

30 Claims, 9 Drawing Sheets

DEVICE HAVING AN EXTENDABLE ANTENNA

BACKGROUND OF THE INVENTION

The invention relates generally to the field of electronics and, more particularly, to electronic and computing devices that include a wireless communications capability.

In modern computing environments, wireless communications between computing devices is gaining in popularity. To bring about this capability, antennas are being integrated into the design of various types of computing devices. While a high level of integration can be advantageous in providing a very capable computing system that is available off-the-shelf, the presence of radio frequency sources within the enclosure of the portable computing device can cause interference and performance degradation of the computing device. For this reason, manufacturers have experienced difficulty in integrating radio frequency sources into computing device enclosures.

One approach toward bringing about radio frequency communications in at least a partially integrated fashion is to make use of an external card slot, such as a PCMCIA slot, to provide the wireless communications port. However, this approach results in an RF "appendage" that is both aesthetically inelegant as well as prone to damage when the computing device is placed within in its carrying case. Further, the physical location of the PCMCIA slot is not optimized for use with a radio frequency communications device, resulting in decreased performance of the wireless communications link.

Thus, it is highly desirable for a computing device to incorporate an antenna that is more resistant to damage when the device is stored within its carrying case. It is additionally desirable for the radio frequency equipment to preserve the aesthetic aspects of the computing device.

DESCRIPTION OF THE PREFERRED EMBODIMENTS

Figure 1:
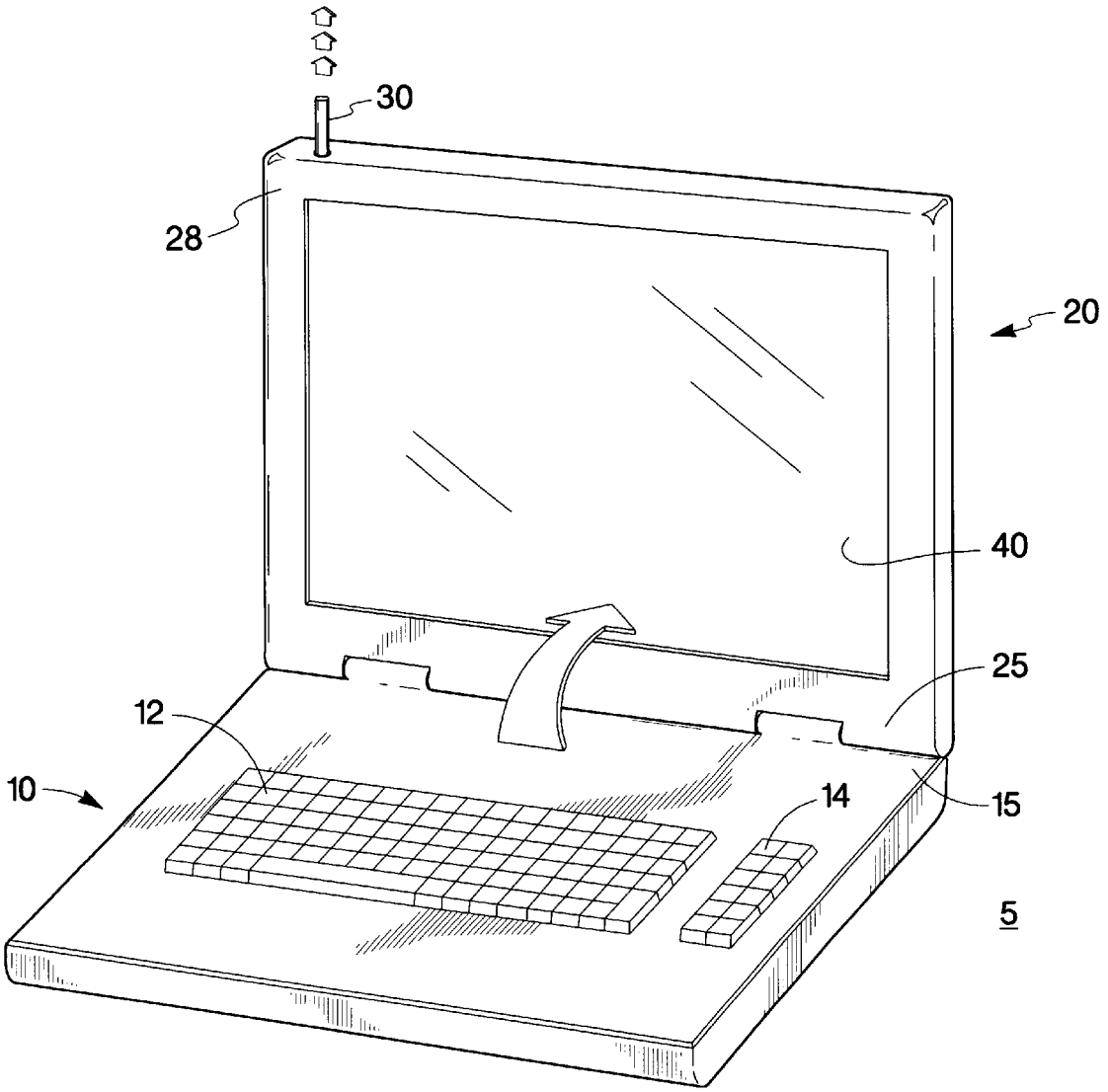
FIG. 1 shows a computing device having an automatically extendable antenna in accordance with a preferred embodiment of the invention.

FIG. 1 shows a computing device having an automatically extendable antenna (30) in accordance with a preferred embodiment of the invention. In FIG. 1, device 5 represents a portable device that provides computing, communications, entertainment, or other function. Thus, device 5 can represent a laptop portable computing unit, a hand-held or palmtop computing unit, or a handheld voice or data communications device. In of FIG. 1, device 5 includes a first enclosure 10 and a second enclosure 20. These enclosures are joined by way of a hinge that attaches edge 15 of first enclosure 10 to first edge 25 of second enclosure 20. In FIG. 1, either one or both of keyboard 12 and keypad 14 provide a data input capability that control the device and control the communications with other peer or peripheral devices by way of antenna 30. Antenna 30 is preferably positioned on second edge 28 of second enclosure 20. Display 40, which is desirably a flat panel type display, enables device 5 to present information to the user.

As second enclosure 20 is rotated about edge 15 of first enclosure 10, antenna 30 automatically extends upward from within second enclosure 20. Further, antenna 30 desirably retracts to a position within second enclosure 20 when the second enclosure is brought into contact with the first enclosure, thus closing the lid of device 5. By way of this automatic extension and retraction, antenna 30 is placed in an operational state that is relatively free from major obstructions and thus able to communicate more effectively with other devices when device 5 is opened. Likewise, when device 5 is closed, antenna 30 is retracted to a location within second enclosure 20 in a manner that preferably precludes damage to the antenna when the device is placed within its carrying case.

Figure 2:
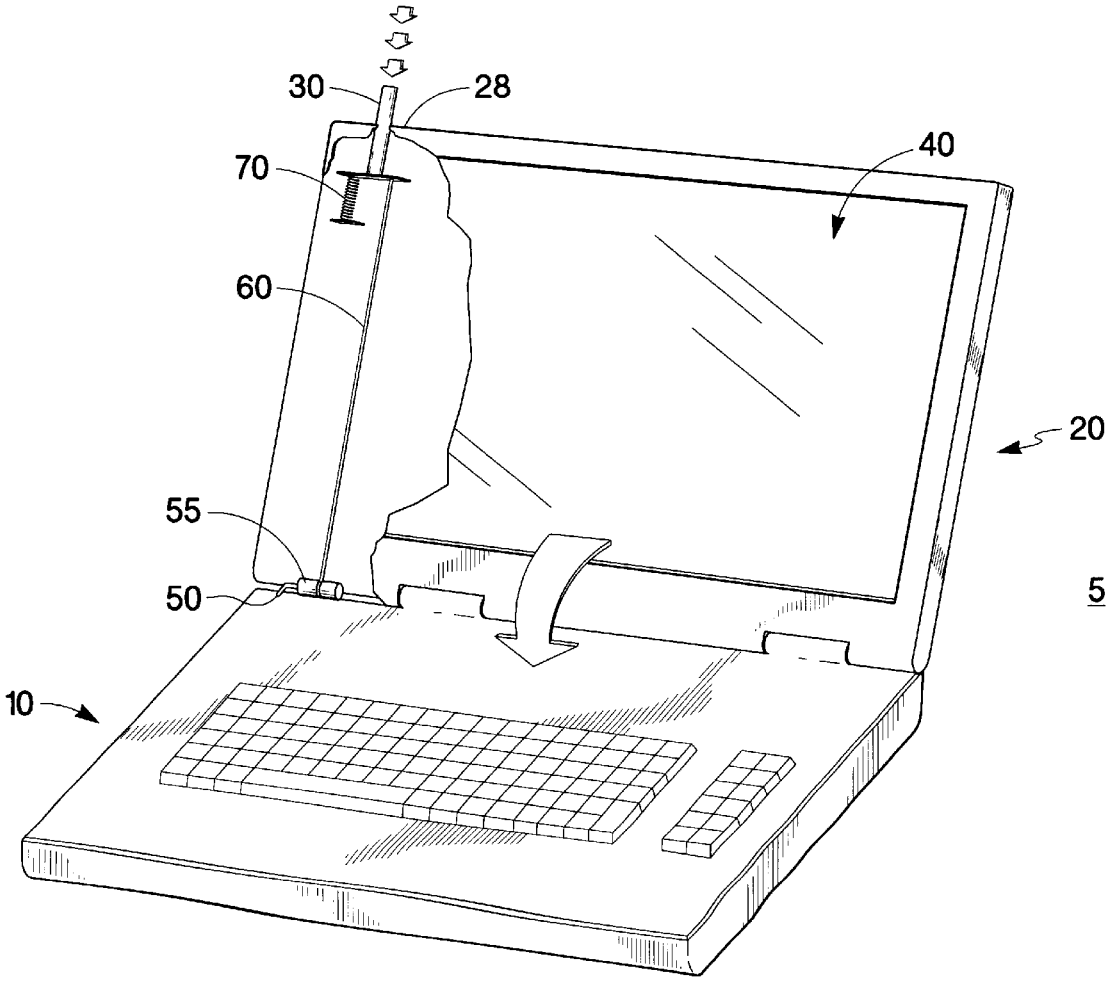
FIGS. 2 and 3 show cutaway views of a portion of a computing device having a linkage that extends an antenna in accordance with a first embodiment of the invention.
Figure 3:
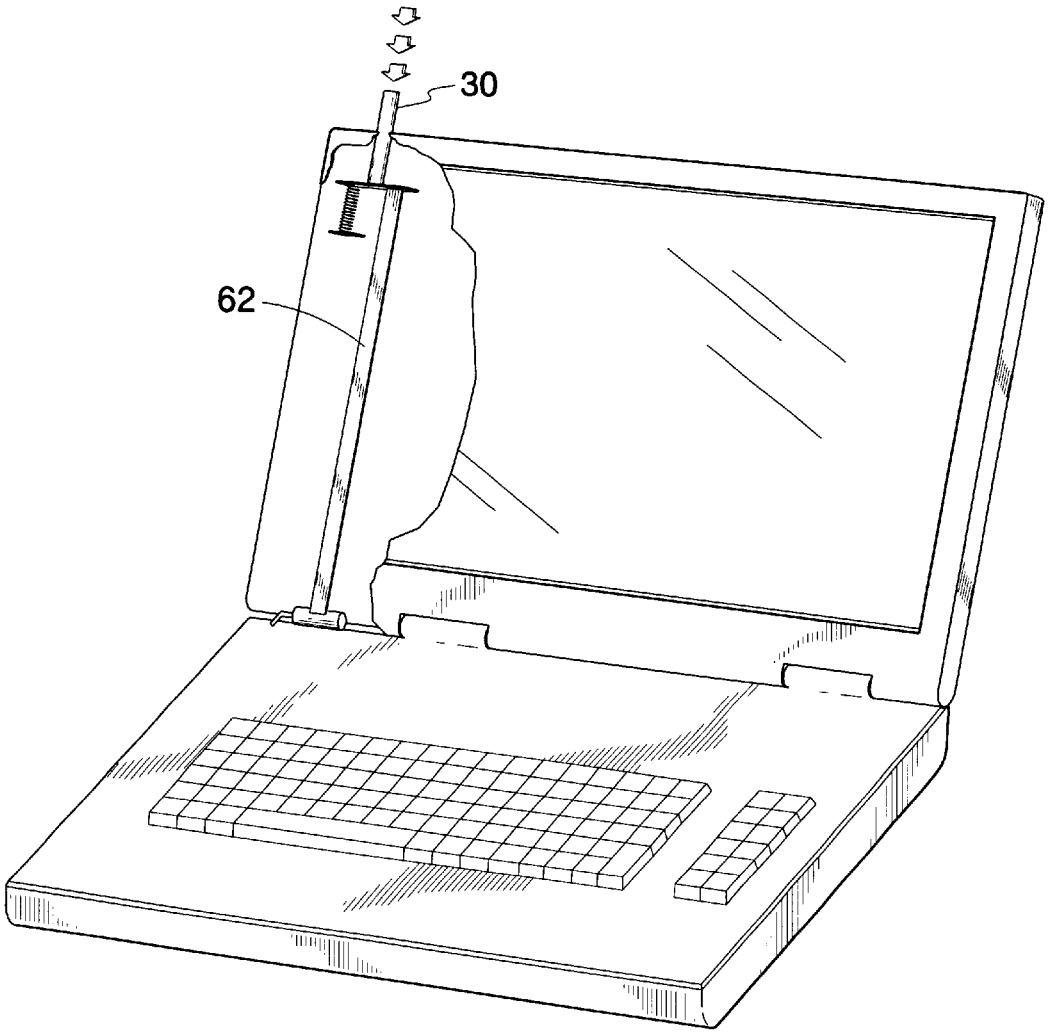

FIGS. 2 and 3 show cutaway views of a portion of a computing device having a linkage that extends an antenna in accordance with a first embodiment of the invention. FIGS. 2 and 3 show the cooperation among elements of the linkage to bring about the extension and retraction of the antenna 30. In FIG. 2, a portion of second enclosure 20 and display 40 have been removed to show the linkage that brings about the extension and retraction of antenna 30 in response to the rotation of second enclosure 20. FIG. 2 shows resilient element 70 that exerts an upward force on a portion of the base of antenna 30, thereby predisposing the antenna towards an extended state. Cable 60, which couples the base of the antenna to a fixed point on curved surface 55, wraps around a portion of the curved surface when second enclosure 20 is rotated to bring the enclosure into proximity with first enclosure 10.

Preferably, anchor pin 50 connects curved surface 55 to a location on edge 15 of first enclosure 10, and remains fixed as enclosure 20 rotates. Although described as a curved surface, cable 60 can wrap around a non-curved surface as second enclosure 20 closes. Details of the cooperation of between the first and second enclosures (10, 20, respectively) of FIG. 2 are explained in greater detail in FIGS. 5 and 6.

In FIG. 2, the coaxial cable or other means of feeding signals to antenna 30 is not shown in order to simplify the description. However, various methods and equipment can be used to couple radio frequency signals between antenna 30 and other components within device 5.

In FIG. 3, ribbon 62 is used in lieu of cable 60 shown in FIG. 2. The use of ribbon 65 may be preferred over cable 60 in some applications in order to provide additional strength in the linkage. However, ribbon 62 may require more volume within second enclosure 20 of device 5, thereby diminishing the appeal of ribbon 62 over cable 60. Desirably, whether cable 60 or ribbon 62 is used to apply tension to the base of antenna 30, the selected tensioning element should possess sufficient strength characteristics.

In FIGS. 2–3, resilient element 70 represents a spring or other elastic component that exerts an upward force on antenna 30. The use of a resilient or an elastic element to exert force in this direction may be desirable in the unlikely event that cable 60 (of FIG. 2) or ribbon 62 (of FIG. 3) breaks at some time during the service life of device 5. In the event of this breakage, antenna 30 would remain extended. Thus, even though the automatic retraction capability of device 5 may not be available, antenna 30 remains available to provide the necessary wireless communications capability. Further, a sliding cover can be placed on the second edge of second enclosure 20, adjacent to antenna 30. This cover can be slid over the opening from which antenna 30 is extended, thereby enclosing the antenna within the second enclosure and disabling the automatic extension of the antenna. Further, when the user desires to make use of antenna 30, the cover can be slid in an opposite direction and allow antenna 30 to extend.

The automatic operation of antenna 30 can also be augmented or replaced by a mechanism that alternatively retains and extends the antenna in a manner that accords to that used to extend and retract the ball of a ballpoint pen. This allows the user to compress antenna 30 to a location substantially even with second edge 28 of second enclosure 20. The antenna can be extended by way of the user depressing antenna 30 a second time in order to release the antenna from its position within the second enclosure.

Figure 4:
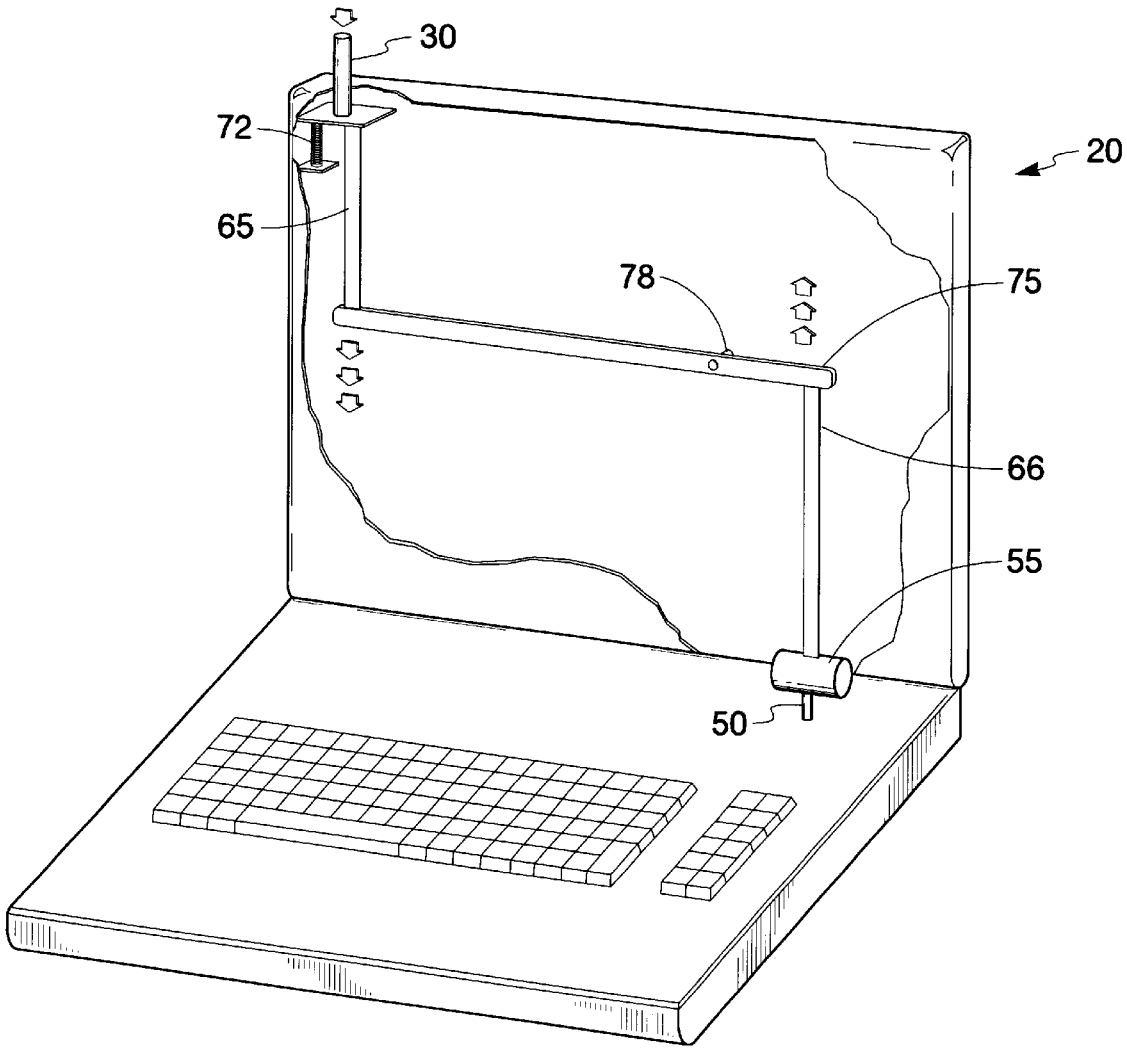
FIG. 4 shows a cutaway view of a portion of a computing device that extends an antenna in accordance with a second embodiment of the invention.

FIG. 4 shows a cutaway view of a portion of a computing device that extends an antenna in accordance with a second embodiment of the invention. In FIG. 4, first ribbon 65 and second ribbon 66 are connected to opposing end portions of lever 75. Note that when lever 75 is used, reducing the length of second ribbon 66 causes antenna 30 to extend, rather than to retract as described in relation to FIGS. 1–3. This is caused by the counter rotation of lever 75 in which an upward movement of one side of the lever brings about the downward movement of the other side.

Pivot 78 is located to adjust the relationship in the amount that antenna 30 is extended and retracted as a function of the amount which second ribbon 66 wraps around curved surface 55 when second enclosure 20 is rotated into proximity with first enclosure 10. Thus, if pivot 78 is placed in the center of lever 75, the amount of extension and retraction that antenna 30 undergoes will be equal to the linear amount which second ribbon 66 wraps around curved surface 55. In FIG. 4, however, pivot 78 is placed to the left of the center of lever 75 so that a movement in the end portion of the lever in contact with second ribbon 66 produces a larger movement in the end portion that is connected to ribbon 65.

Figure 5:
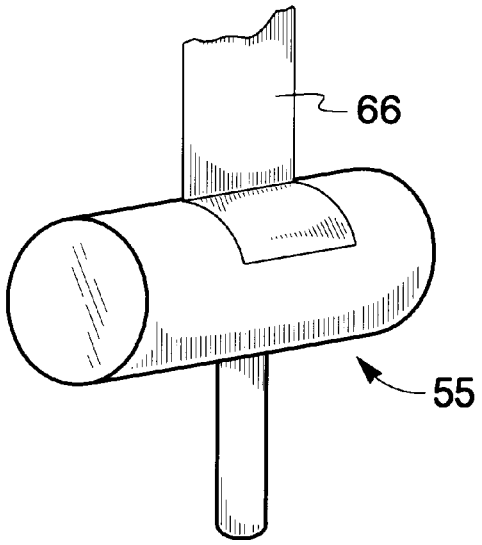
FIGS. 5 and 6 show a curved surface that enables the linkage of FIG. 4 to extend and retract a computing device antenna in accordance with the second embodiment of the invention.
Figure 6:
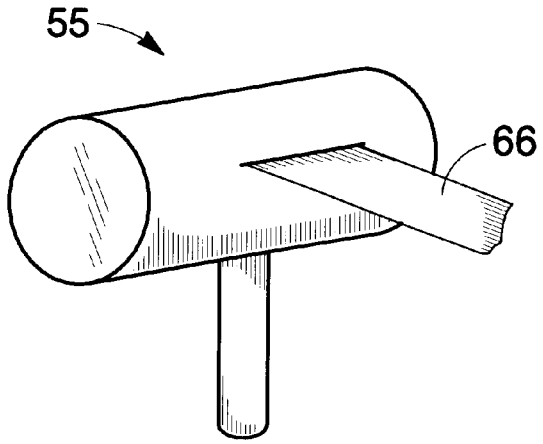

FIGS. 5 and 6 show a curved surface that enables the linkage of FIG. 4 to extend and retract a computing device antenna in accordance with the second embodiment of the invention. The location of second ribbon 66, which originates from a location near the front and center portion of the curved surface of FIG. 5 and wraps around a portion of curved surface 55, corresponds to second enclosure 20 being in the open position, such as that shown in FIG. 4. When device 5 is in the closed position, second ribbon 66 unwraps from around the portion of curved surface 55, as shown in FIG. 6. This unwrapping brings about an increase in the length of the second ribbon 66, thereby allowing the right side portion of lever 75 to rotate upward. This upward rotation brings about a downward rotation of the left side portion of lever 75 permitting resilient element 72 (of FIG. 4) to retract antenna 30 into second enclosure 20.

Figure 7:
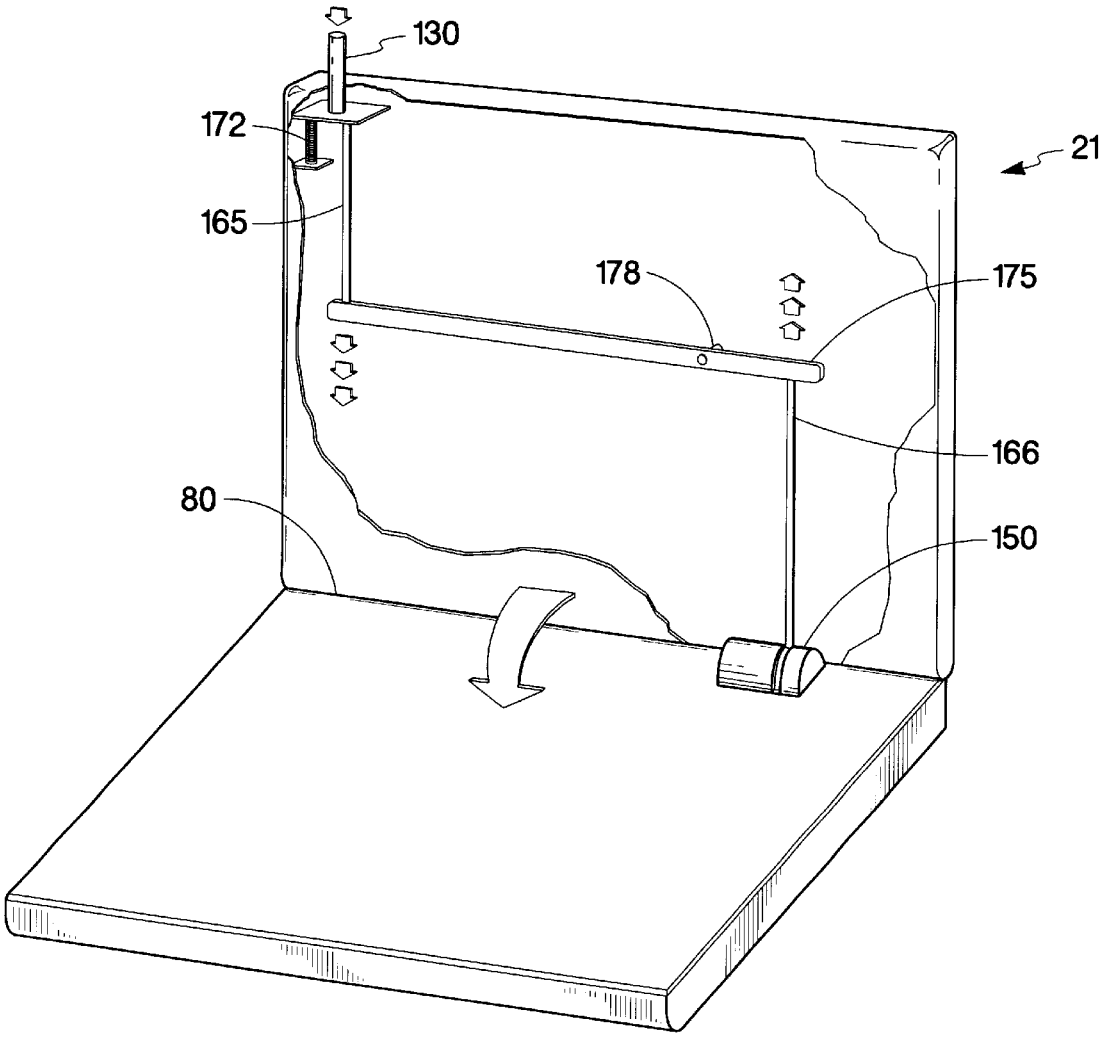
FIG. 7 shows a linkage that extends a computing device antenna in accordance with a third embodiment of the invention.

FIG. 7 shows a linkage that extends a computing device antenna in accordance with a third embodiment of the invention. In FIG. 7, resilient element 172 predisposes antenna 130 to the retracted position, as opposed to the extended position discussed in FIGS. 1–4. To extend antenna 130 against the bias created by resilient element 172, first shaft 165 pushes upward on a base portion of antenna 130. This upward force is conveyed by way of lever 175, which pivots about pivot 178.

As second enclosure 21 is rotated about hinge line 80, second shaft 166 contacts curved surface 150. Curved surface 150 represents a preferably curved surface having a center axis parallel to, but not coincident with hinge line 80. Thus, as second enclosure 21 is rotated, the base portion of second shaft 166 slides along the outer portion of curved surface 150 from a point nearby hinge line 80 to a location that is more distant from the hinge line. This movement causes the right portion of lever 175 to rotate upward while the left portion of the lever moves downward.

Curved surface 150 can be located on the left side of the computing unit of FIG. 7. In this embodiment, second shaft 166 is extended to allow the shaft to directly interact to the base of antenna 130. Curved surface 150 would be modified so that the base portion of second shaft 166 slides along the outer portion of curved surface 150 from a point farthest from hinge line 80 to a point closer to the hinge line as second enclosure 21 is rotated to close the device of FIG. 7.

Figure 8:
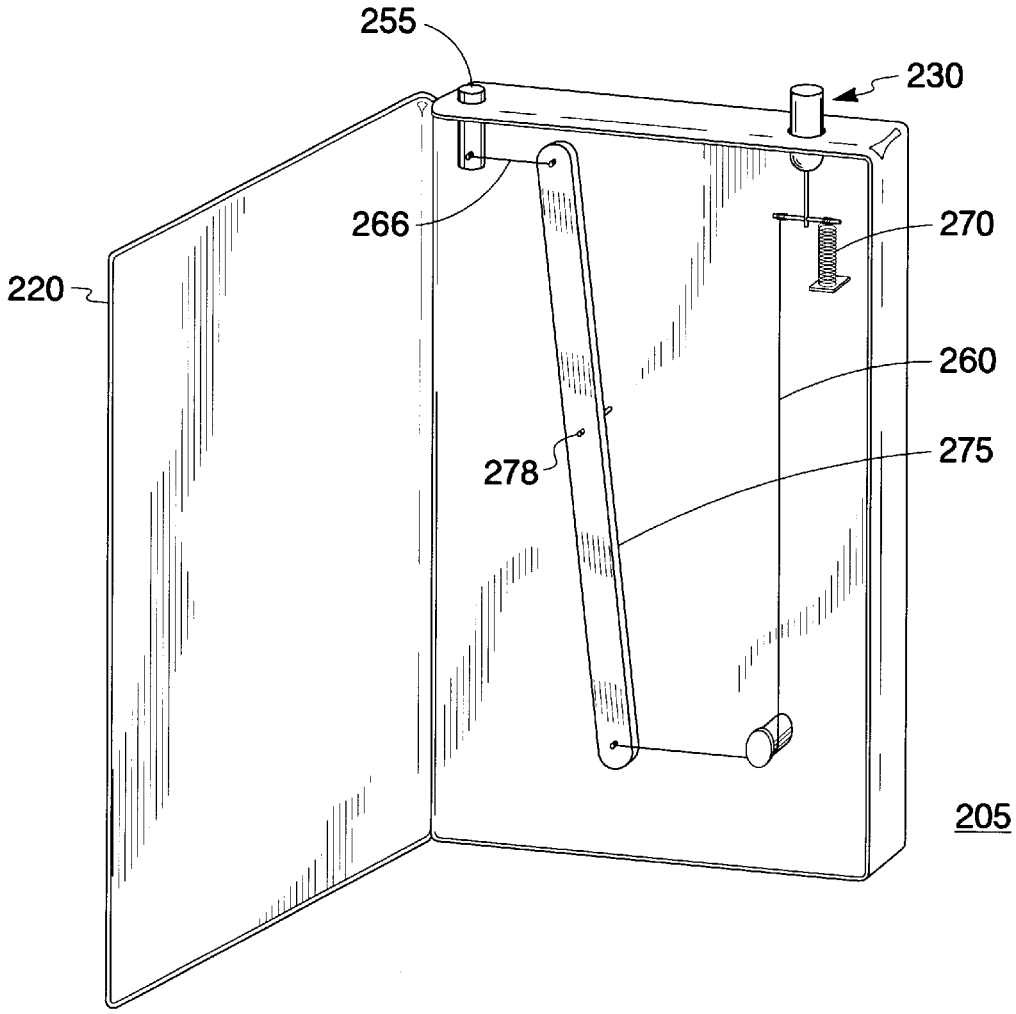
FIG. 8 is a view of an internal portion of another computing device that includes an extendable antenna in accordance with a fourth embodiment of the invention.

FIG. 8 is a view of an internal portion of another computing device (205) that includes an extendable antenna in accordance with a fourth embodiment of the invention. In FIG. 8, a hand held device, such as a personal digital assistant, personal entertainment device, or other electronic system, includes cover 220, which is opened during an operation of the device. As cover 220 is opened, by way of rotating the cover about hinge 255, cable 266 is pulled to the left, thereby pulling the top portion of lever 275 to the left. This action rotates the lower portion of lever 275 about pivot 278 to the right, as shown in FIG. 8. This motion causes cable 260 to slacken, thereby allowing resilient element 270 to relax and extend antenna 230 from computing device 205.

Figure 9:
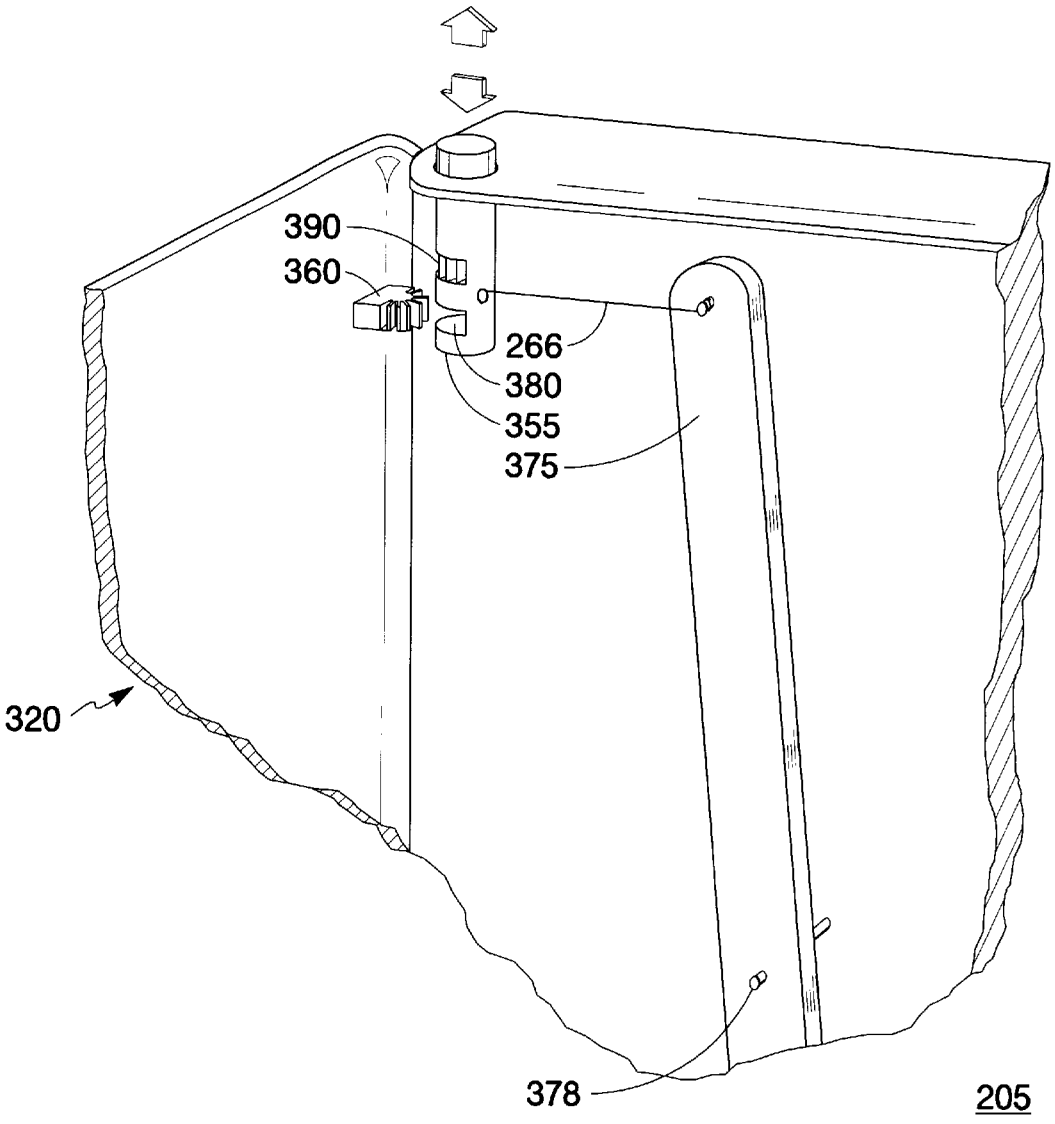
FIG. 9 shows a mechanism that includes provisions for disabling the automatic extension of the antenna of FIG. 8 in accordance with the fourth embodiment of the invention.

FIG. 9 shows a mechanism that includes provisions for disabling the automatic extension of the antenna of FIG. 8 in accordance with the fourth embodiment of the invention. In FIG. 9, hinge-clutch 355 enables the user to influence the automatic deployment of an associated communications antenna. To bring about this capability, hinge-clutch 355 is allowed to move in an upward and downward direction. When hinge-clutch 355 is extended upward (as shown) gear 360 fits within slot 380, thereby decoupling lever 375 from the opening and closing of cover 320.

When hinge-clutch 355 is moved downward, mating gear 390 is brought into contact with gear 360. This enables mating gear 390 to turn about a central axis in response to the motion of cover 320, thus allowing cable 266 to wrap around a portion of the outer surface of hinge-clutch 355. This wrapping, in turn, pulls the upper of portion of lever 375 to the left, thereby allowing a lower portion of lever 375 to rotate towards the right (about pivot 378) and extend the antenna coupled by way of a cable (not shown) attached to the lower portion of lever 375.

Figure 10:
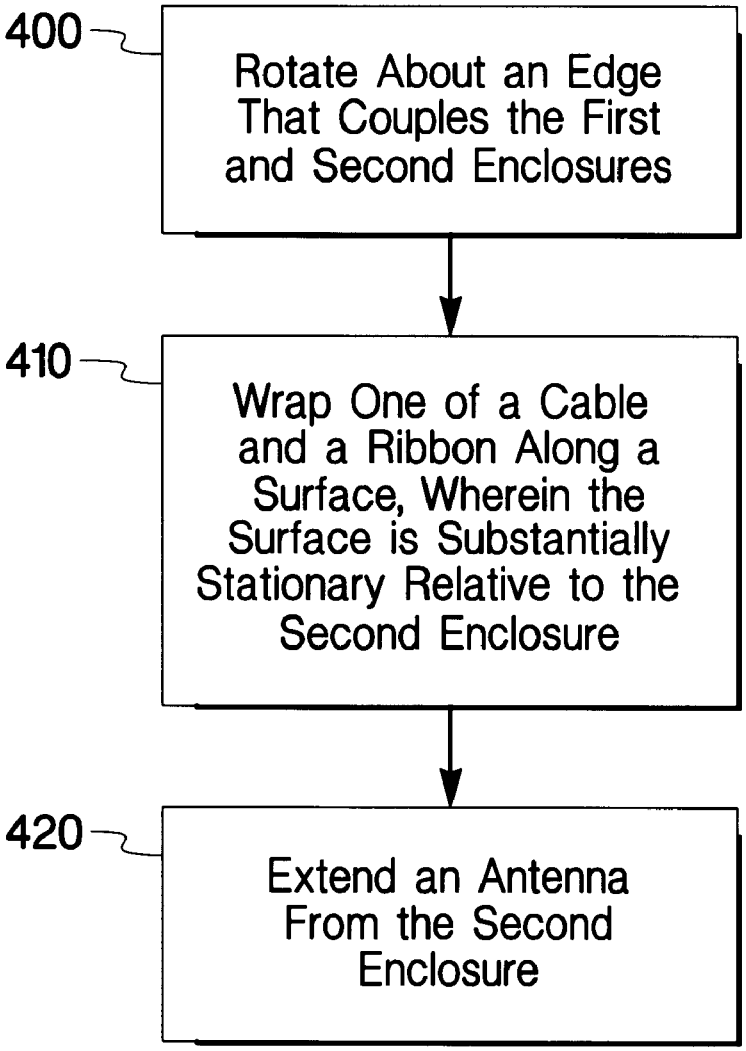
FIG. 10 shows a flowchart of a method for extending an antenna from a computing device in accordance with an embodiment of the invention.

FIG. 10 shows a flowchart of a method for extending an antenna from a computing device in accordance with an embodiment of the invention. The apparatus of FIG. 1 is suitable for performing the method of FIG. 4. The method begins at block 400 in which the second enclosure rotates about an edge that couples the first and second enclosures. At block 410, one of a cable and a ribbon are wrapped along a surface, wherein the surface is substantially stationary relative to the second enclosure, and wherein the wrapping action subtracts a first amount of length of the selected ribbon or cable. The wrapping action of block 410 can optionally include moving a first end portion of a lever by a first amount of length. This movement desirably brings about movement of a second end portion of the lever wherein the second end of the lever may move by an amount similar, greater than, or less than the first amount of length. The method concludes at block 420 with an antenna being extended from the second enclosure. Preferably, the extending is caused by a resilient element extending to a relaxed position by an amount proportional to the first amount of length.

What is claimed is:

1. A device having an extendable antenna, comprising:

a first enclosure;

a second enclosure, wherein a first edge of said second enclosure is coupled to an edge of said first enclosure; and an antenna, located within said second enclosure, said antenna being coupled to a linkage that cooperates with said first enclosure to extend said antenna when an edge opposite said first edge of said second enclosure is rotated about said edge of said first enclosure, said linkage comprising a resilient element coupled to said antenna, said resilient element being relaxed when said antenna is extended.

2. The device of claim 1 wherein said first enclosure includes at least one of a keyboard and a keypad on a surface of said first enclosure.

3. The device of claim 1 additionally comprising a display on a surface of at least one of said first and said second enclosure.

4. The device of claim 1 wherein said linkage cooperates with said edge of said first enclosure to extend said antenna.

5. The device of claim 1 wherein said linkage further comprises a cable that wraps around a curved surface when said edge opposite said first edge of said second enclosure is rotated about said edge of said first enclosure.

6. The device of claim 1 wherein said linkage further comprises a cable that couples said antenna to a shaft that slides along a curved surface at said edge of said first enclosure when said edge opposite said first edge of said second enclosure is rotated about said edge of said first enclosure.

7. The device of claim 1 wherein said linkage further comprises a lever, wherein an end portion of a first side of said lever is coupled to said antenna, and wherein an end portion of a second side of said lever is coupled to a curved surface by way of said cable.

8. The device of claim 7 wherein said first side of said lever is coupled to said antenna by way of a second cable that connects between a base portion of said antenna and said end portion of said first side of said lever.

9. The device of claim 1 wherein said linkage further comprises a ribbon that couples said antenna to a curved surface, said ribbon wrapping around said curved surface when said edge opposite said first edge of said second enclosure is rotated toward a first surface, thereby retracting said antenna.

10. The device of claim 1 wherein said linkage further comprises a cable that couples said antenna to a shaft that slides along a curved surface at said edge of said first enclosure.

11. The device of claim 1 wherein said linkage further comprises a lever, wherein an end portion of a first side of said lever is coupled to said antenna, and wherein an end portion of a second side of said lever is coupled to a curved surface by way of said ribbon.

12. The device of claim 11 wherein said first side of said lever is coupled to said antenna by way of a second ribbon that connects between a base portion of said antenna and said end portion of said first side of said lever.

13. The device of claim 12, wherein said first side of said lever is of a greater length than said second side of said lever.

14. The device of claim 1 wherein said linkage comprises a resilient element that is relaxed when said antenna is retracted.

15. The device of claim 14 wherein said linkage further comprises a shaft that extends said antenna, said shaft having an end that slides along a curved surface at said edge of said first enclosure.

16. The device of claim 14 wherein said linkage further comprises a lever, wherein an end portion of a first side of said lever is coupled to said antenna, and wherein an end portion of a second side of said lever is coupled to a shaft having an end that slides along a curved portion of said edge of said first enclosure.

17. The device of claim 16 wherein said first side of said lever is coupled to said antenna by way of a second shaft that connects between a base portion of said antenna and said end portion of said first side of said lever.

18. The device of claim 16, wherein said first side of said lever is longer than said second side of said lever.

19. In a device that includes a first and second enclosure, a method for extending an antenna from said second enclosure, comprising:

said second enclosure rotating about an edge that couples said first and second enclosures;

wrapping one of a cable and a ribbon around a surface, said surface being substantially stationary relative to said second enclosure, said wrapping action subtracting a first amount of length of said one of said ribbon and said cable; and extending said antenna from said second enclosure, said extending being caused by a resilient element being extending to a relaxed position by an amount proportional to said first amount of length.

20. The method of claim 19, wherein said wrapping action further comprises moving a first end portion of a lever by said first amount of length, said movement of said first end portion of said lever bringing about movement of a second end portion of said lever by a second amount of length, said second amount of length being substantially equal to said first amount of length.

21. The method of claim 19, wherein said wrapping action further comprises moving a first end portion of a lever by said first amount of length, said movement of said first end portion of said lever bringing about movement of a second end portion of said lever by a second amount of length, said second amount of length being less than said first amount of length.

22. The method of claim 19, wherein said wrapping action further comprises moving a first end portion of a lever by said first amount of length, said movement of said first end portion of said lever bringing about movement of a second end portion of said lever by a second amount of length, said second amount of length being greater than said first amount of length.

23. A linkage which causes an antenna to extend from within an enclosure when said enclosure is rotated in a first direction about an edge, said edge being coupled to an edge of a second enclosure, said linkage comprising:

means for predisposing said antenna toward an extended position;

means for applying a force to retract said antenna from said enclosure when said enclosure is rotated about said edge in a direction opposite said first direction; and means for producing said force in response to said enclosure being rotated about said edge in a direction opposite said first direction.

24. The linkage of claim 23 further comprising means for adjusting the relationship between a linear amount that said antenna is retracted and an amount that said enclosure is rotated.

25. The linkage of claim 23 wherein said antenna is located proximate to a second edge of said enclosure.

26. The linkage of claim 23 wherein said means for applying said force includes a tensioning element.

27. The linkage of claim 26 wherein said tensioning element is a cable.

28. The linkage of claim 27 wherein said cable wraps around a portion of a curved surface when said enclosure is rotated about said edge in a direction opposite said first direction.

29. The linkage of claim 26 wherein said tensioning element is ribbon.

30. The linkage of claim 29 wherein said ribbon wraps around a portion of a curved surface when said enclosure is rotated about said edge in a direction opposite said first direction.

* * * * *